US008499974B2

(12) United States Patent
Bennett

(10) Patent No.: US 8,499,974 B2
(45) Date of Patent: Aug. 6, 2013

(54) AUTOMATIC LIGHT SWITCH ON A SELF DEFENSE DEVICE

(76) Inventor: Ron Bennett, Trenton, TN (US)

( * ) Notice: Subject to any disclaimer, the term of this patent is extended or adjusted under 35 U.S.C. 154(b) by 403 days.

(21) Appl. No.: 12/632,070

(22) Filed: Dec. 7, 2009

(65) Prior Publication Data

US 2011/0132929 A1 Jun. 9, 2011

(51) Int. Cl.

| | |
|---|---|
| ***B65D 5/66*** | (2006.01) |
| ***B65D 83/00*** | (2006.01) |
| ***B67D 7/84*** | (2010.01) |
| ***B67D 1/07*** | (2006.01) |
| ***B67D 7/06*** | (2010.01) |
| ***F21V 33/00*** | (2006.01) |
| ***F41G 1/34*** | (2006.01) |
| ***G08B 21/00*** | (2006.01) |

(52) U.S. Cl.

USPC ..... 222/113; 222/175; 222/192; 222/402.13; 362/96; 362/101; 362/110; 340/664; 340/687; 340/686.4

(58) Field of Classification Search

USPC ..... 222/113, 192, 175, 179.5, 183, 402.13, 222/116, 276, 802; 362/276, 96, 101, 110, 362/113; 340/664, 687, 686.4, 6.1, 815.45, 340/384.4, 571

See application file for complete search history.

(56) References Cited

U.S. PATENT DOCUMENTS

| | | | | |
|---|---|---|---|---|
| 1,219,109 | A | | 5/1917 | Kaplan |
| 3,737,650 | A | | 6/1973 | Kaye |
| 3,806,724 | A | | 4/1974 | Tanner |
| 3,832,705 | A | * | 8/1974 | King et al. ..... 340/571 |
| 3,902,058 | A | | 8/1975 | Naylor |
| D244,796 | S | | 6/1977 | Staub |
| 4,408,263 | A | | 10/1983 | Sternlicht |
| 4,434,914 | A | * | 3/1984 | Meshberg ..... 222/153.11 |
| 4,516,194 | A | | 5/1985 | Johns |
| 4,633,232 | A | * | 12/1986 | Nelson et al. ..... 340/542 |
| 4,750,095 | A | | 6/1988 | Huang |
| 4,837,559 | A | * | 6/1989 | Green, Sr. ..... 340/573.1 |
| 5,307,249 | A | | 4/1994 | Vanwynsberghe |
| 5,420,766 | A | | 5/1995 | Hollis |
| 5,549,220 | A | | 8/1996 | Whalen |
| 5,629,679 | A | | 5/1997 | Cranford |
| 5,673,819 | A | * | 10/1997 | Brunswig ..... 222/113 |
| 6,052,051 | A | | 4/2000 | Whalen |
| 6,118,380 | A | * | 9/2000 | Gannon ..... 340/573.4 |

(Continued)

FOREIGN PATENT DOCUMENTS

WO WO 2008115336 A1 * 9/2008

*Primary Examiner* — Paul R Durand
*Assistant Examiner* — Matthew Lembo
(74) *Attorney, Agent, or Firm* — John Steckler Schwab

(57) ABSTRACT

A hand-held non-lethal self-defense chemical spray device possessing a focused light source that automatically activates upon removal of the device from a holster to aid in the safe and effective use of the device by the operator such as a law enforcement officer. The focused light source emits a light in the direction of the chemical spray prior to and during discharge of the device to aid in the aiming of the chemical spray and assist the operator in seeing the target in low-light conditions. The focused light source automatically turns-on upon removal of the device from a holster, and automatically turns-off upon replacement of the device inside the holster. The spray canister does not require the user to manually activate the light source and retains similar size shape and form to that of a conventional self defense spray canister already in use by law enforcement officers nationwide.

16 Claims, 8 Drawing Sheets

U.S. PATENT DOCUMENTS

| | | | | |
|---|---|---|---|---|
| 6,439,432 | B1 | 8/2002 | Park | |
| 6,499,855 | B1 | 12/2002 | Kukuk | |
| 6,676,270 | B2 | 1/2004 | Kostal | |
| 6,896,192 | B2 * | 5/2005 | Horan et al. | 239/1 |
| 6,948,827 | B2 * | 9/2005 | Tally | 362/196 |
| 7,004,597 | B2 | 2/2006 | Kukuk | |
| 7,121,432 | B2 * | 10/2006 | Kostal et al. | 222/192 |
| 7,152,990 | B2 | 12/2006 | Kukuk | |
| 7,347,583 | B2 | 3/2008 | Britt | |
| 7,524,076 | B2 | 4/2009 | Kukuk | |
| 2004/0129730 | A1 | 7/2004 | Parsons | |
| 2005/0092773 | A1 * | 5/2005 | Kostal et al. | 222/192 |
| 2007/0183146 | A1 * | 8/2007 | Swartfager | 362/208 |
| 2007/0194048 | A1 | 8/2007 | Teig | |
| 2008/0245818 | A1 | 10/2008 | Strictland | |
| 2009/0127283 | A1 | 5/2009 | Smith | |
| 2010/0096472 | A1 * | 4/2010 | Klein et al. | 239/73 |

* cited by examiner

AUTOMATIC LIGHT SWITCH ON A SELF DEFENSE DEVICE

BACKGROUND OF THE INVENTION

The current invention relates to hand-held non-lethal self-defense chemical spray apparatuses such as those used by law enforcement. Law enforcement personnel encounter situations where they must restrain a suspect from doing harm to themselves, the officer or a third party by using nonlethal force. Chemical spray weapons provide a means for the officer to inflict a temporary blinding and painful sensation that distracts, confuses and disables such individuals. Traditional chemical spray weapons do not provide an adequate means by which the officer can quickly aim the weapon, especially in low light situations. Failure to properly aim the weapon may lead to an officer discharging excess spray possibly leading to secondary exposure of the officer or possibly inadequately subduing the suspect. Such a situation could lead to a potentially life threatening situation for the suspect, the officer, or a third party.

BRIEF SUMMARY OF THE INVENTION

An object of the present invention is to improve officer safety by providing a non-lethal chemical spray weapon having a focused light source illuminating both the suspect and the path of the spray, the light source automatically actuating upon removal of the weapon from its holster eliminating the extra step of activating a separate light.

Another object of the present invention is to improve officer safety by providing a chemical spray weapon with an automatically actuated focused light source in a traditional cylindrical spray canister form that the officer is familiar with carrying and operating.

Yet another object of the present invention is to improve officer safety by providing a chemical spray weapon with an automatically actuated focused light source that requires no additional steps over a traditional chemical spray weapon to take advantage of the additional safety features offered by the invention.

Another object of the present invention is to improve officer safety by providing a reliable chemical spray weapon with an automatically actuated focused light source having a component minimizing design adaptable for use with a conventional spray canister and valve assemblies of proven reliability.

Yet another object of the present invention is to providing a chemical spray weapon with an automatically actuated focused light source that is compact and easily carried on the officer's utility belt.

In addition, due to a component minimizing design of the device, ability to be adapted to be utilized with conventional spray canisters, and ability to be reused with a new spray canister after discharge of the weapon, the device is capable of low costs of manufacture and low costs of ownership.

The chemical spray weapon includes a valve button housing removably attached to the upper end of a pressurized spray canister. The canister contains a chemical irritant and propellant and may contain other substances including dyes and luminescent chemicals. The upper end of the pressurized spray canister possesses a manually actuated valve for release of the contents. The valve button housing contains a base portion that snap-fits onto the canister and a wall extending upward from the base portion to house a focused light source circuit and a valve button.

The operator manually depresses the valve button to actuate the canister valve to release the canister contents. The valve button contains an orifice tube and nozzle portion allowing the contents of the canister to be ejected from the spray canister in the direction desired by the operator and with a spray pattern and flow rate as desired by the manufacturer. The valve button may be retained by the valve button housing to allow the button to longitudinally slide within the housing, or it may be retained by a pivotal attachment to the housing.

The focused light source projects a beam of light in the direction of the spray. The light provides the operator with means of aiming the chemical spray prior to discharging the weapon and provides additional light by which the operator can see the subject. The focused light source circuit comprises a power source, a light source, and a switch that is activated upon removal of the device from its holder. Preferably a light emitting diode (LED) serves as the light source. The LED may be chosen by the manufacturer that matches the desired wavelength, focal pattern, and intensity desired.

The end use or utility of the device is nearly identical to that of a traditional non-lethal chemical spray weapon; however its use can be more quickly implemented. Upon encountering a situation in which a chemical spray weapon is needed, the officer removes the weapon from his holster, automatically activating a focused light source in the spray housing cap. The shape and operation of the weapon is the same as that of a traditional weapon of this type, with the spray activated by a button on the top of the canister. When the officer no longer requires use of the spray, he simply replaces the weapon back into the holster, deactivating the light. No additional buttons are required on the device to activate the light source. Such a design eliminates the need for the officer to fumble with additional buttons or switches while attempting to control a potentially dangerous and highly stressful situation.

The present invention allows the officer to use the focused light source to illuminate the suspects head and shoulders and aim the chemical spray directly at the suspects face. This feature reduces chance of missing the intended target and maximizes the amount of spray available to subdue the suspect. Additionally, the focused light source reduces the chance of the officer accidentally subjecting himself to accidental exposure to the spray. The automatically activating feature ensures that the light is always active upon removal of the device from its holster and reduces the steps that would otherwise be required of a manually activated light source.

BRIEF DESCRIPTION OF THE DRAWINGS

The invention is illustrated by the accompanying drawings, in which.

DETAILED DESCRIPTION OF THE INVENTION

The drawings illustrate a non-lethal self-defense chemical spray device having a light source pointing in the direction of the spray wherein the light source automatically actuates upon removal from a holder.

Figure 1:
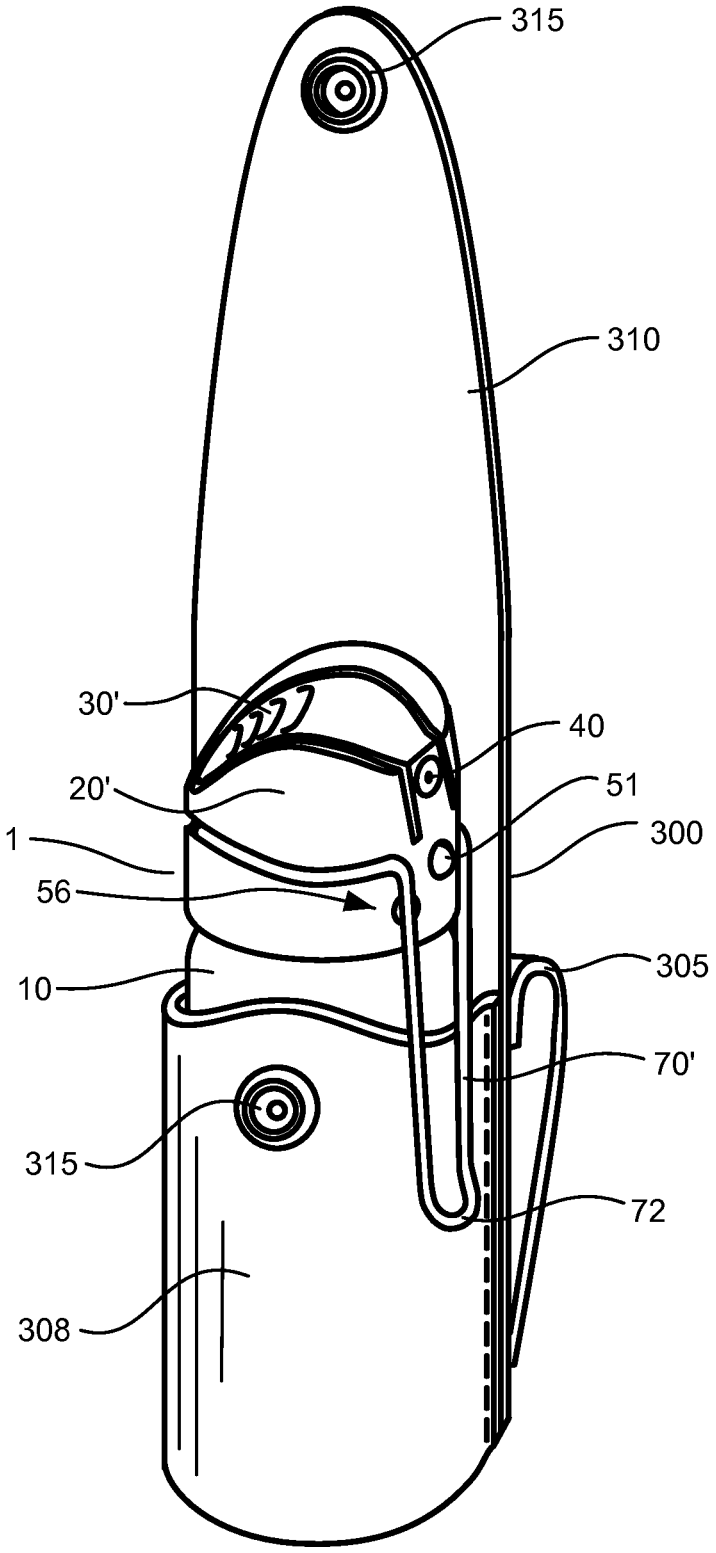
FIG. 1 is a perspective view of an embodiment of the self defense device placed inside a typical holster.

FIG. 1 shows a first embodiment of the present invention. The self-defense spray device 1 is generally carried in a holder such as a holster 300. Such holsters usually have a clip or loop 305 for securing the holster to a belt, a pocket portion 308 in which the device 1 can be inserted, a closure flap 310 to prevent accidental loss or discharge of the device 1 and a two part snap fastener 315 to secure the flap 310 in a closed position, not shown. The self defense device 1 has a lower pressurized cylindrical canister portion 10 and a top valve button housing 20 having a valve actuator button 30 and discharge nozzle 40. In the current embodiment, the valve button 30 is hingedly connected to the valve button housing 20 below the discharge nozzle 40. The device 1 also possesses a focused light source 51 and switch 56 for automatically actuating the light source 51. In the present embodiment, the focused light source 51 is located in the button housing 20 of the device 1. Also in the present embodiment, the switch 56, is actuated by a lever arm or clip 70 such that when the device is removed from the holster 300 or similar holder, the light source 51 activates illuminating the target and indicating the path of the spray prior to and during discharge of the weapon 1. In the current embodiment, when the device is placed into the holster 300 or similar holder, the holster wall 308 bends the lever arm or clip 70 out of contact with contact 58 deactivating the focused light source.

Figure 2:
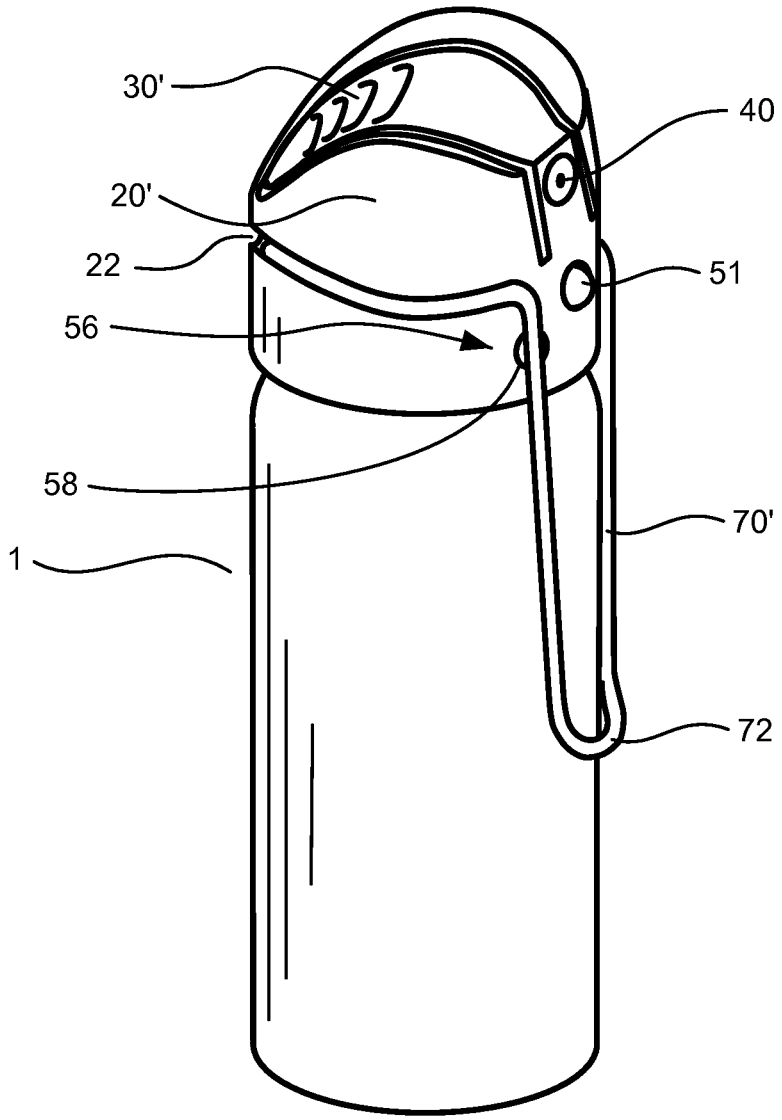
FIG. 2 is a perspective view of the device in FIG. 1 removed from the holster showing a pivotally attached valve button and a groove retained clip.

FIG. 2 shows the device 1 removed from the holster. When removed from the holster as shown, the switch 56 activates the focused light source 51. In the present embodiment shown, the lever arm or clip 70 is constructed from an electrically conductive material such as steel, stainless steel, titanium alloy, aluminum, or any other suitable electrically conductive material. The clip 70 possesses a blunt end 72 curved away from the device 1 to guide the clip 70 to the outside of the pocket portion 308 when inserting the device 1 into the holster 308. In the present embodiment, the clip 70 is retained in a groove 22 in the valve button housing 20 of the device 1. In the present embodiment, the switch 56 is comprised of an electrical contact 58 imbedded within the top portion 20 of the device 1 and the clip 70 which is springedly biased to touch the electrical contact 58. When the device 1 is removed from the holster 300, the clip 70 touches the electrical contact 58 allowing current to flow through the clip to the light source 51.

While the present embodiment features an electrically conductive clip 70 as a component of the switch 56, the switch may have self contained contacts such as a momentary push button switch or micro-switch that is physically depressed by the clip 70 which may or may not be electrically conductive itself, or the switch may be depressed directly by a part of the holster 300, The lever arm or clip 70 may be designed so that it fits on the inside of the holster 300, thereby being pressed inward towards the wall of the canister 10 by the pocket portion 308 of the holster 300 and turning the light 51 off. In the preferred embodiments, the lever arm 70 fits on the outside of the holster 300, whereby the switch 56 is disengaged turning the light 51 off when the device 1 is placed in the holster 300.

Figure 3:
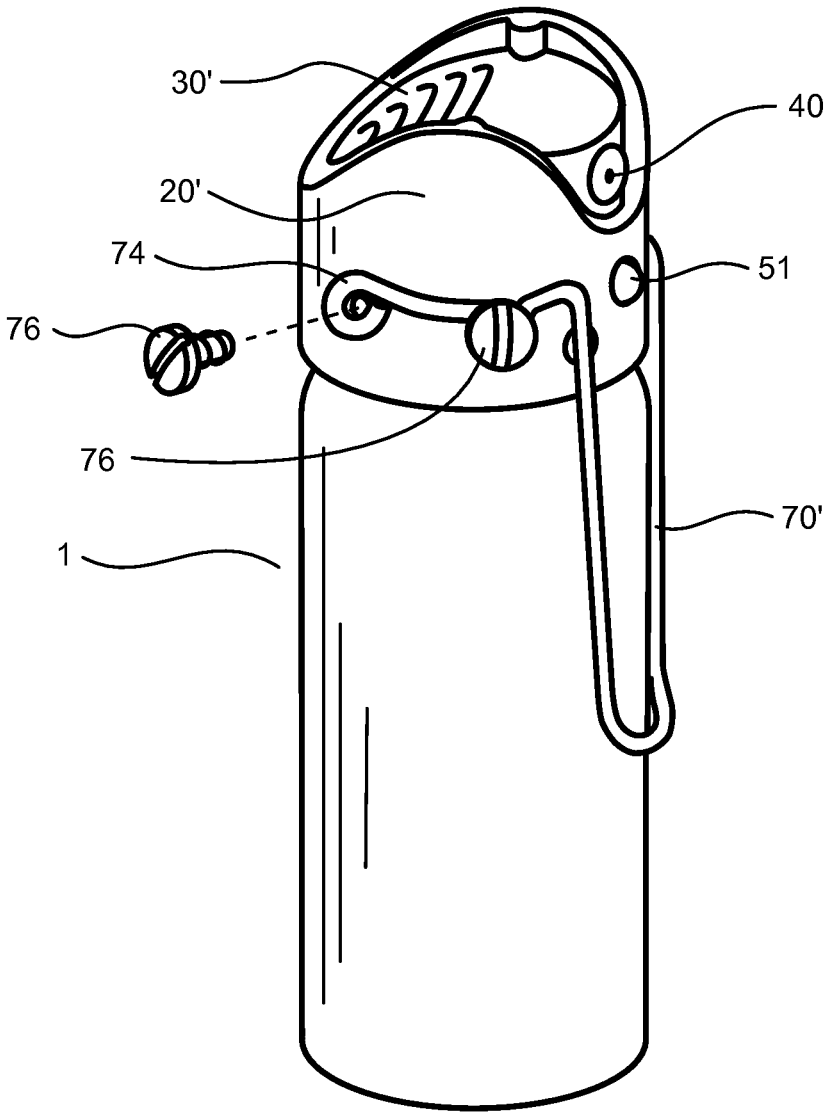
FIG. 3 is a perspective view of another embodiment of the device showing a vertically sliding valve button and a fastener retained clip.

In a second embodiment of the self defense device 1, the clip 70' may be attached by retainers 76 such as screws or rivets as shown in FIG. 3. In this embodiment, the clip 70' rests on the outside surface of the button housing 20' and is secured with screws 76 threaded into suitable openings in the button housing. The clip 70' is shaped such that an aperture 74 or "u" shaped opening allows the screw 76 to pass through the clip 70' and fasten it to the button housing 20. While the current embodiment shown in FIG. 3 shows the clip not retained within a groove 22, retainers can easily be used in conjunction with a groove to retain the clip 70'. Also featured in the embodiment shown in FIG. 3 is a biased spray valve button actuator 30' that vertically translates in relation to the button housing 20'. It should be noted, however, that other valve button designs can be adapted to be used with the present invention.

Figure 4:
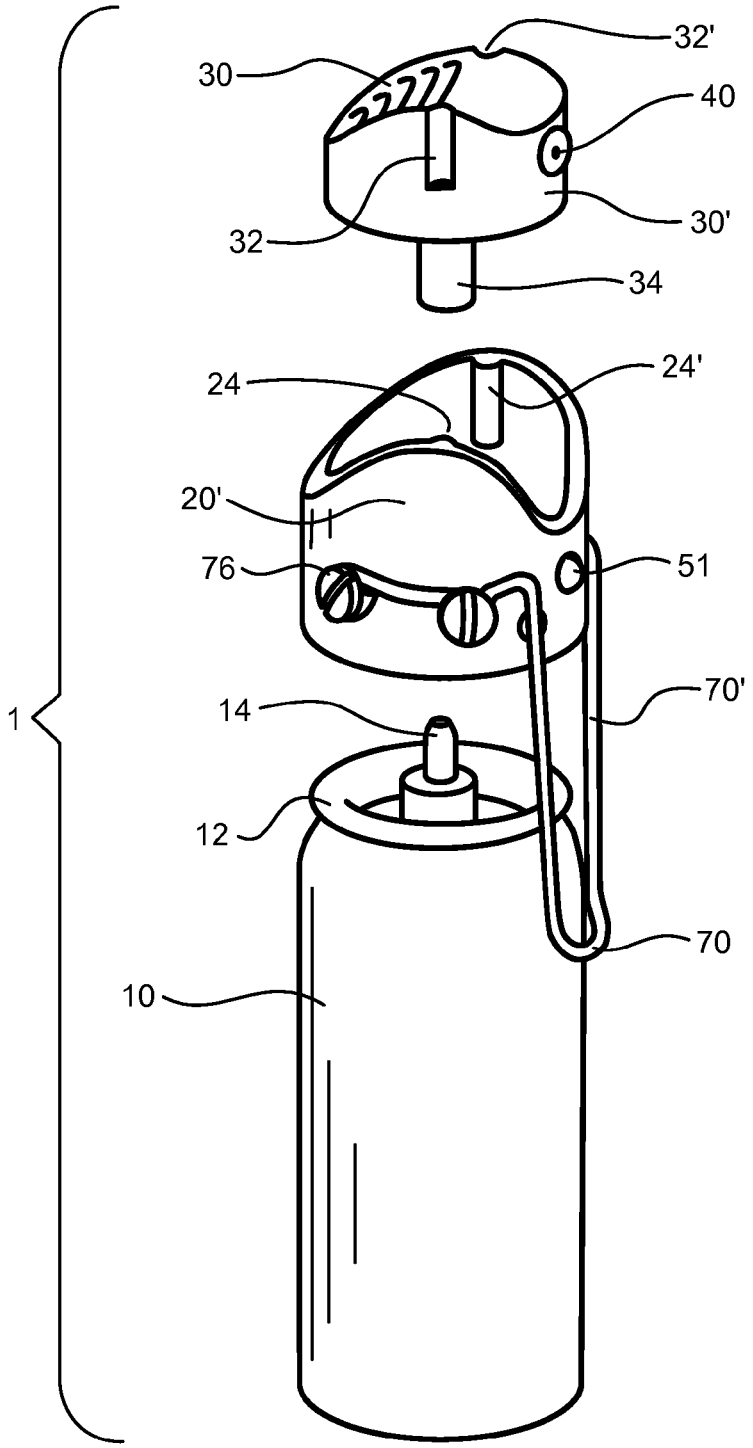
FIG. 4 is a perspective exploded view of the device in FIG. 3.

FIG. 4 shows an exploded view showing the canister 10, valve button housing 20', and valve button 30' of the embodiment of the invention shown in FIG. 3. In this embodiment, the valve button 30' is restrained from axially rotating about the valve stem 14 by a pair of diametrically opposed and radially inward protruding flanges 24, 24' on the valve button housing 20' that slideably engage axially extending grooves 32, 32' in the valve button 30'. A variety of other construction methods known in the art may be used to prevent axial rotation of the valve button 30', including, but not limited to, placing at least one flange in the valve button 30' and at least one mating groove in the valve button housing 20', placing at least one groove in the valve button 30' and at least one mating flange in the valve button housing 20', or shaping the valve button and corresponding surfaces on the valve button housing so that they possesses a non-circular shape. The valve button 30' may be retained within the valve button housing 20' by means not shown and in the disclosed embodiment the valve stem 14 is press fit within a bore of the valve stem nipple 34. The valve button housing 20' may be releasably attached to the rim 12 of the pressure canister 10 that contains a propellant, irritant, and possibly other substances including dyes or luminescent agents. The releasable attachment of the valve button housing 20' to the canister 10 is preferably achieved by a snap-fit connection that allows the components containing the invention to be removed from the canister 10 and to be reused with a new canister.

Figure 5:
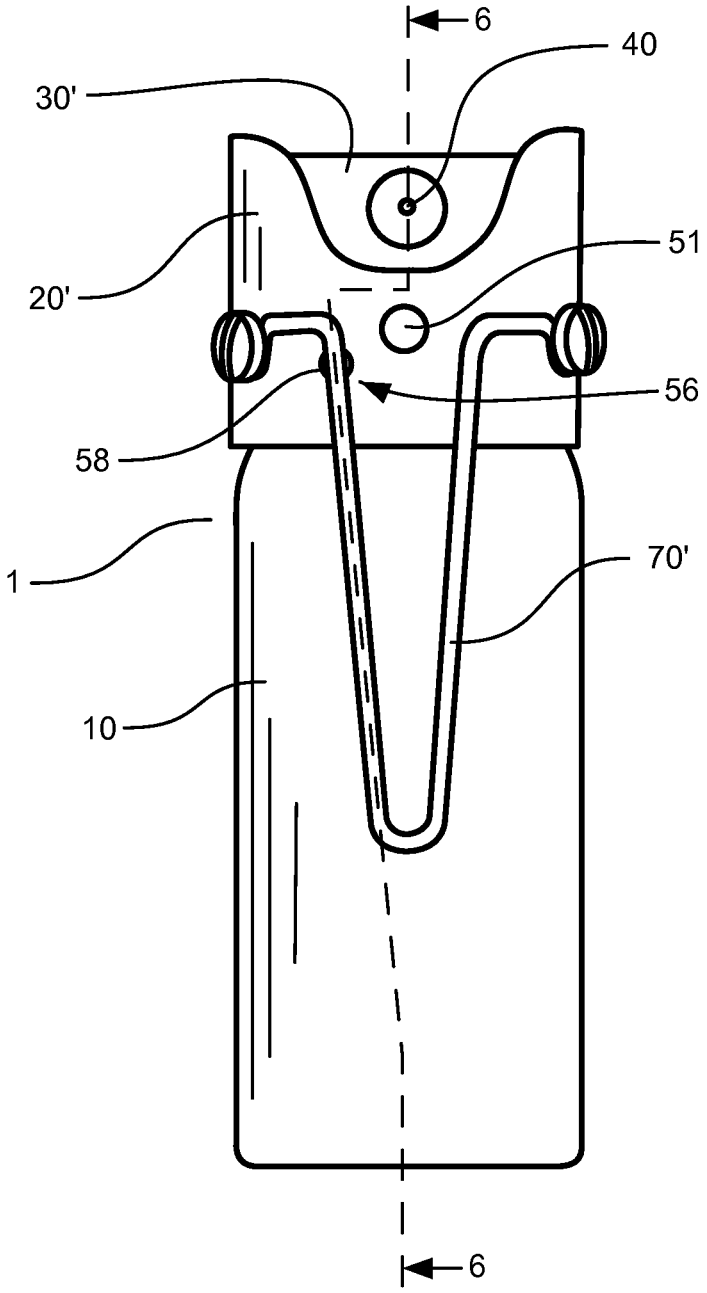
FIG. 5 is a front view of the device in FIG. 3.

FIG. 5 shows a frontal view of the second embodiment of the self defense device. The focused light source 51, as with the first embodiment, is preferably located directly below the spray nozzle 40. The light source 51 may be displaced to the left or right of the spray nozzle 40 or even above the spray nozzle 40, provided the projected beam of light is aimed in the direction of the spray nozzle 40.

Figure 6:
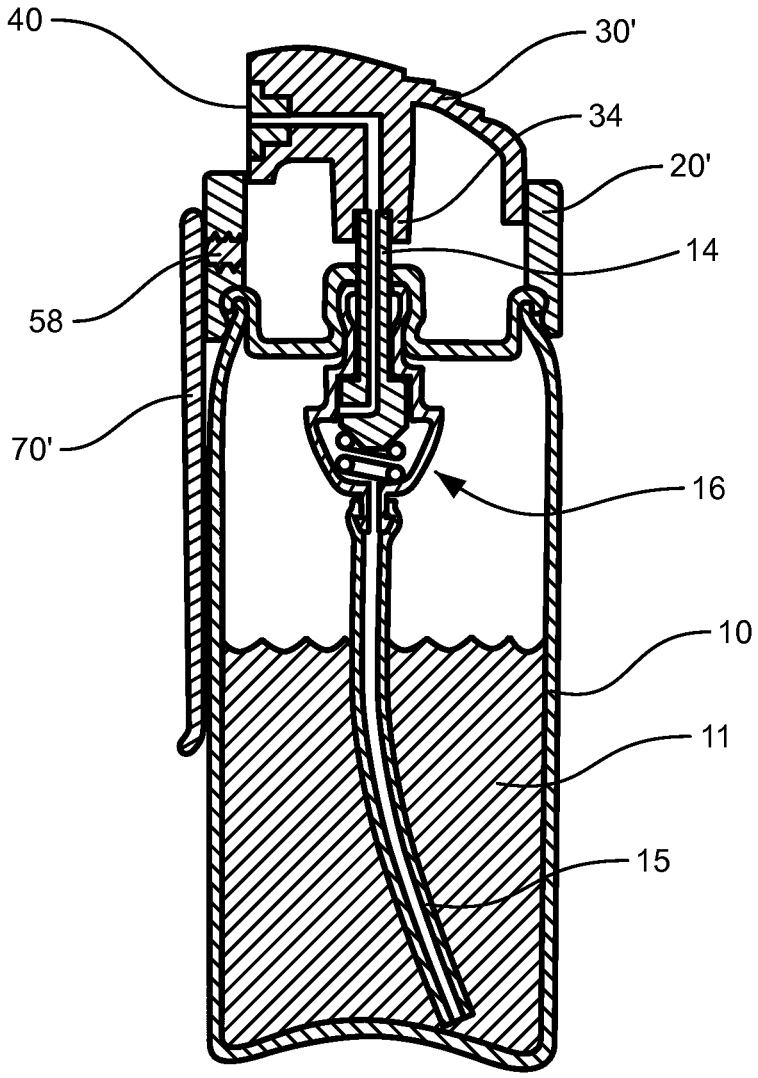
FIG. 6 is a sectional view taken on line 6-6 in FIG. 5 showing the switch contact, valve and valve button.

FIG. 6 shows a sectional view along the line 6-6 in FIG. 5. As shown, when removed from the holster 300 the clip 70 makes contact with the electrical contact 58, thereby allowing electricity to flow from the power source, through the clip 70 and electrical contact 58 of the switch 56 and through the focused light source or light 51. This feature automatically turns the light on, eliminating the need for the operator to remember to turn on the light source 51, and relieves the operator from having to perform another step during high stress situations. To discharge the weapon, the operator presses the valve button 30', thereby depressing the spring biased valve stem 14 downward opening the valve 16 and allowing the pressurized contents 11 of the canister 10 to flow up the diptube 15 and out the nozzle 40 in the direction of the focused light source 51.

Figure 7:
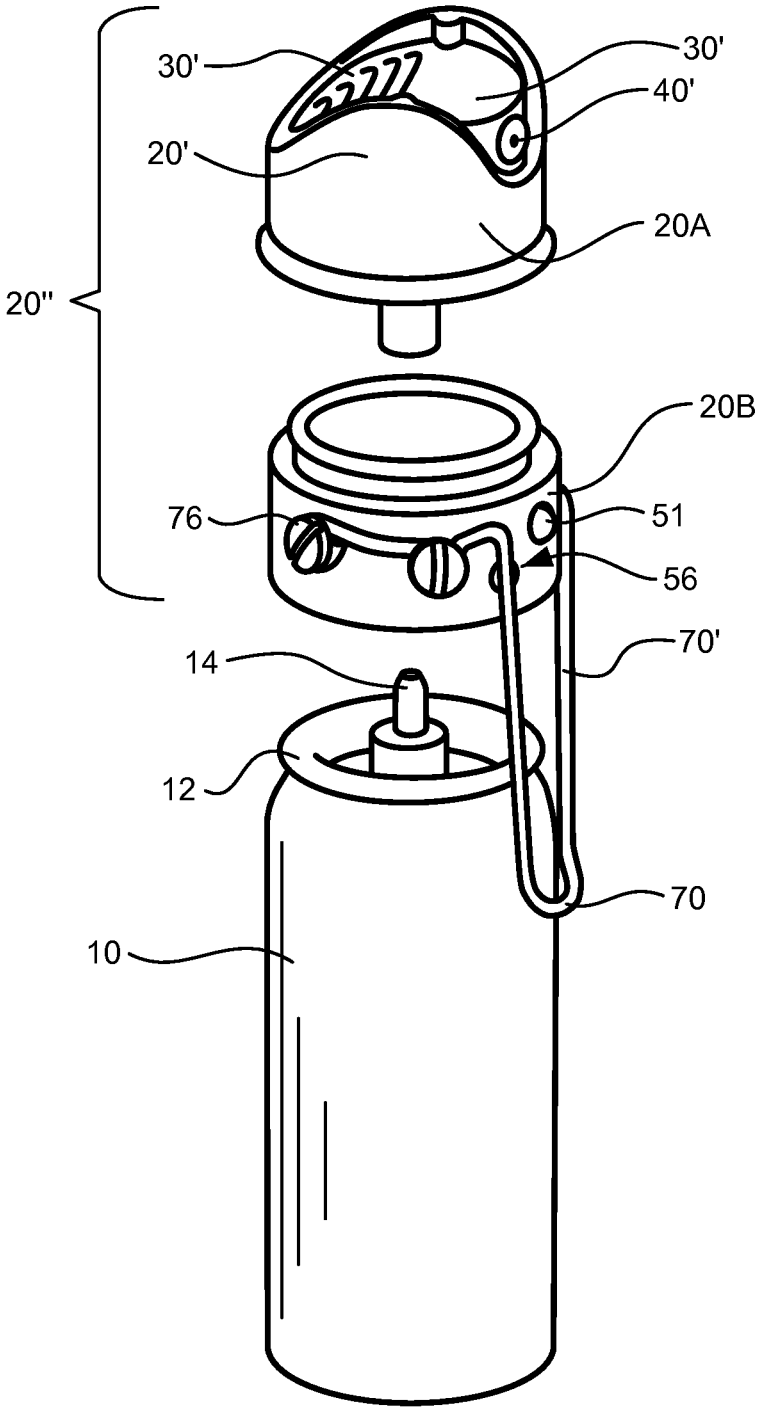
FIG. 7 is an exploded view of an embodiment of the device having an upper valve button housing and a lower valve button housing and FIG. 8 is a perspective view of the focused light source circuit with the valve button, valve button housing and canister removed, showing the focused light source, switch and power source.

FIG. 7 shows an exploded view of third embodiment of the invention where the valve button housing 20" separates into an upper section 20A and a lower section 20B. The upper section 20A of the valve button housing contains the valve button 30' with its valve stem nipple 34 engageable with the valve stem 14. The lower valve button housing 20B contains the focused light source 51, the clip 70', and the switch 56.

Figure 8:
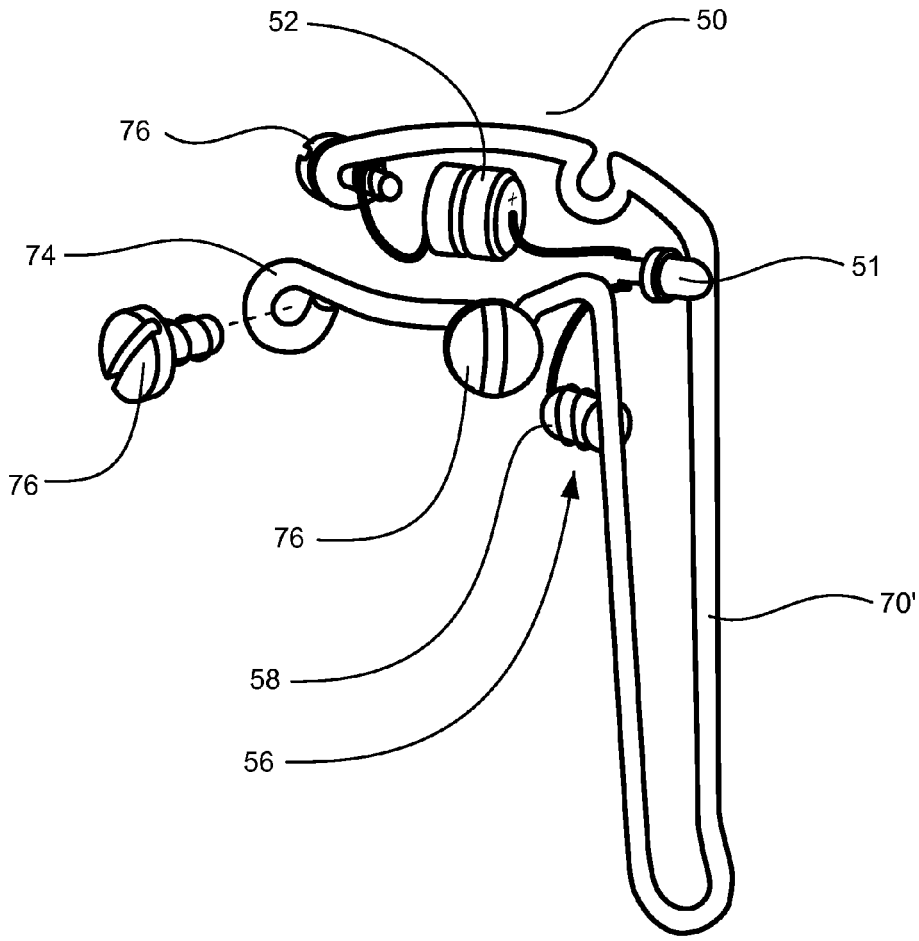

FIG. 8 shows a view of a focused light source circuit 50 removed from the valve button housing 20. The clip 70' is connected to a voltage source 52 which is in-turn connected to the focused light source 51. The focused light source 51 may be any light source capable of projecting a beam or cone of light, including incandescent light bulbs, lasers, and light emitting diodes (LEDs) with and without reflectors or lenses. Where a collimated beam of light is desired, a modern laser diode may be used as the focused light source 51. Preferably the focused light source consists of an LED having a wavelength, focal pattern, and intensity as specified by the manufacturer. The focused light source 51 is connected to the switch 56. In this embodiment the switch 56 is comprised of the electrical contact 58 and the clip 70'. When the clip 70' makes contact with the electrical contact 58, the focused light source 51 illuminates.

While the circuit is comprised of a focused light source 51, voltage source 52, and a switch 58 connected in series, other components may also be included in the circuit, including a manual cut-off switch to turn off the light regardless of the state of the switch 58, a manual over-ride switch to turn on the focused light source 51 regardless of the state of switch 58, and resistors to adjust the amount of current and or voltage passing through the focused light source 51.

What is claimed is:

1. A chemical spray apparatus comprising:

a pressure canister containing irritant and propellant having a top end, a bottom end and a side wall, said canister being adapted to be releasably supported in a holster;

a valve assembly having a top end and a bottom end, said valve assembly bottom end attached to said top end of said canister for releasing said irritant including;

a valve button housing;

a manually actuated valve button in said valve button housing for actuating said valve;

a focused light source;

an electrical contact imbedded in said valve button housing; and a conductive lever member having a first end rigidly attached to said valve button housing and a second end extending beyond said valve assembly bottom end and adjacent to said side wall of said canister;

said conductive lever and said electrical contact being connected in series with said focused light source so as said lever conducts current from said end rigidly attached to said valve button housing to said electrical contact, said lever being biased to engage said electrical contact and to disengage therefrom upon said apparatus being inserted into said holder, such that said switch turns on or off said focused light source upon being removed from or inserted into, respectively, said holder.

2. The apparatus of claim 1 in which said valve button housing releasably attaches to the top end of said canister.

3. The apparatus of claim 1 in which said focused light source comprises:

at least one light emitting diode and a power source.

4. The apparatus of claim 1 in which said valve button is pivotally attached to said valve button housing.

5. The apparatus of claim 1 in which said valve button vertically translates with respect to and is retained by said valve button housing.

6. A chemical spray apparatus releasably attachable to a pressure canister adapted to be carried in a holder and containing irritant and propellant, said canister having a top end, a bottom end, a side wall, and a manually actuated valve attached to its top end for releasing said irritant, said apparatus comprising:

a valve button housing releasably attachable to said top end of said canister, said valve button housing having a top end and a bottom end, said valve button housing bottom end attached to said top end of said canister;

a valve manually actuatable button in said housing shiftable between open and closed positions;

a nozzle in said valve button for directing irritant in a predetermined direction;

a focused light source in said valve button housing, said light source directing light parallel to and in the same direction as said nozzle directs irritant and an electrical contact imbedded in said valve button housing; and a lever member comprising of a resiliently flexible metal strip, said lever member having a first end and a second end, said first end attached to said valve button housing, said second end extending down past said bottom of said valve button housing;

said lever and said electrical contact being connected in series with said focused light source so as said lever conducts current from said first end of said lever member to said electrical contact, said lever being biased to engage said electrical contact and to disengage therefrom upon said apparatus being inserted into said holder so as to form a switch, such that said switch turns on or off said focused light source upon being removed from or inserted into, respectively, said holder.

7. The apparatus of claim 6 in which said focused light source comprises:

at least one light emitting diode and a power source.

8. The apparatus of claim 6 in which said valve button is pivotally attached to said valve button housing.

9. The apparatus of claim 6 in which said valve button vertically translates with respect to and is retained by said valve button housing.

10. A chemical spray apparatus comprising:

a pressure canister adapted to be carried in a holder, said canister containing irritant and propellant and having a bottom end and a side wall and a top end with a manually actuatable valve for releasing said irritant;

an upper valve button housing, said upper valve button housing having a top end and a bottom end;

a valve button with sufficient movement for actuating said valve;

a lower valve button housing, said lower valve button housing having a top end and a bottom end;

a focused light source contained within said lower valve button housing;

an electrical contact imbedded in said lower valve button housing; and a conductive lever member having a first end and a second end, said first end rigidly attached to said lower valve button housing, said second end extending down past said bottom end of said lower valve button housing;

said conductive lever and said electrical contact being connected in series with said focused light source so as said lever conducts current from said end rigidly attached to said lower valve button housing to said electrical contact, said lever being biased to engage said electrical contact and to disengage therefrom upon said apparatus being inserted into said holder so as to form a switch, such that said switch turns on or off said focused light source upon being removed from or inserted into, respectively, said holder.

11. The apparatus of claim 10 in which said bottom end of said upper valve button housing releasably attaches to said top end of said lower valve button housing.

12. The apparatus of claim 10 in which said bottom end of said lower valve button housing releasably attaches to said top end of said canister.

13. The apparatus of claim 10 in which said focused light source comprises:

at least one light emitting diode and a power source.

14. The apparatus of claim 10 in which said lower valve button housing receives:

said focused light source: and said switch.

15. The apparatus of claim 14 in which said valve button is pivotally attached to said upper valve button housing.

16. The apparatus of claim 14 in which said valve button vertically translates with respect to and is retained by said upper valve button housing.

* * * * *